US005160817A

United States Patent [19]

Wiktor et al.

[11] Patent Number: 5,160,817

[45] Date of Patent: Nov. 3, 1992

[54] ELECTRICAL SWITCH CONTACT ARRANGEMENT HAVING QUICK BREAK ARCING CONTACTS

[75] Inventors: Dominik M. Wiktor, Cranford; Siegfried Schlindwein, Succasunna, both of N.J.

[73] Assignee: Automatic Switch Company, Florham Park, N.J.

[21] Appl. No.: 616,390

[22] Filed: Nov. 21, 1990

[51] Int. Cl.[5] ..... H01H 33/12; H01H 9/38

[52] U.S. Cl. ..... 200/146 R

[58] Field of Search ..... 200/144 R, 144 AP, 146 R, 200/146 A, 146 AA, 11 B, 15, 254, 259-261

[56] References Cited

U.S. PATENT DOCUMENTS

| | | | |
|---|---|---|---|
| 2,959,654 | 11/1960 | Caswell et al. | 200/146 R |
| 3,215,803 | 11/1965 | Goodwin, Jr. | 200/146 R |
| 3,345,485 | 10/1967 | Engel | 200/146 R |
| 3,402,274 | 9/1968 | Bould | 200/146 R |
| 3,560,683 | 2/1971 | Maier et al. | 200/146 R |
| 3,562,459 | 2/1971 | Bould et al. | 200/146 R |
| 4,996,507 | 2/1991 | McKee et al. | 200/147 R |
| 5,025,121 | 6/1991 | Allen et al. | 200/254 |

*Primary Examiner*—J. R. Scott

*Attorney, Agent, or Firm*—Alan H. Levine; Howard F. Mandelbaum

[57] ABSTRACT

An electrical switch contact arrangement having a spring which snaps the movable arcing contact away from the stationary arcing contact at a high rate of speed to open the arcing contacts, but only after the movable main contact has moved through a considerable portion, for example, at least about 50%, of its opening movement away from the stationary main contact. The spring is tensioned as the main contacts open. At an intermediate point during the opening movement of the movable main contact, the moveable main contact positively initiates opening movement of the arcing contacts whereupon the spring snaps the arcing contacts open at a high rate of speed independent of the opening speed of the main contacts.

12 Claims, 6 Drawing Sheets

ELECTRICAL SWITCH CONTACT ARRANGEMENT HAVING QUICK BREAK ARCING CONTACTS

BACKGROUND OF THE INVENTION

Industrial type switches, such as transfer switches, contacters, circuit breakers, and interrupters, are required to handle heavy electrical loads, typically comprising hundreds and even thousands of amperes at voltages ranging up to 15,000 volts AC and 1,500 volts DC.

Every switching operation produces arcing between the cooperating switch contacts, and when the electrical load being handled is heavy, the arcing created has the potential to cause considerable damage to the contacts. To mitigate this problem, it is customary to protect the main contacts, which carry the load, with arcing contacts which open after the main contacts open and close before the main contacts close. Thus, in theory, the arc is drawn only between the arcing contacts and not between the main contacts. The latter are formed of relatively soft, good conducting metals, such as silver or copper, which have low melting points and hence are very susceptible to damage by uncontrolled arcing. The arcing contacts are made of materials, such as refractory metals, e.g., tungsten, capable of withstanding extremely high temperatures while experiencing only moderate erosion. Nevertheless, the sacrificial activity of arcing contacts does eventually lead to damage, but they are easily field replaceable.

A problem develops due to the fact that the impedance of the arcing contacts is much higher than that of the main contacts. As a result, during opening of a switch, when all current flowing through the main contacts is transferred to the arcing contacts, a voltage drop is created across the main contacts while the air gap between them is still quite small. Consequently, on occasion, an arc is engendered between the separating main contacts potentially damaging to those contacts. If the current level is sufficiently high, unacceptable damage can occur rendering the main contacts unusable, thereby requiring major repair or replacement of the switch. The problem becomes more acute if, at the critical moment of main contact separation, the arcing contacts bounce or are otherwise disturbed in a manner which increases their impedance.

Environments in which the damage of arcing between the main contacts is particularly severe are those in which the switch is called upon to handle excessive motor loads or transformer inrush currents which are by their nature highly inductive. Thus, when switching highly inductive loads on a DC circuit, such as traction motors in a typical transit system, it is important to ensure as much as possible that all arcing takes place across the arcing contacts and none across the main contacts.

Even when an arc is confined to the arcing contacts, it is important that the arc be extinguished as quickly as possible. Rapid quenching of the arc not only minimizes erosion of the arcing contacts, but reduces the opportunity for the arc to jump into the gap between the opening main contacts.

From the discussion above, it will be appreciated that arcing across, and consequent damage to, the main contacts can be eliminated or at least greatly reduced, by insuring as large an air gap as possible between the opening main contacts before the arcing contacts begin to separate, and by thereafter insuring very rapid opening of the arcing contacts.

SUMMARY OF THE INVENTION

It is therefore an object of the present invention to provide an electrical switch contact arrangement having arcing contacts spring-biased to open at very high speed after the main contacts have opened and have initiated opening of the arcing contacts.

It is another object of the invention to provide such an electrical switch contact arrangement wherein the movable main contact moves through at least one half of its opening movement away from the stationary main contact before opening of the arcing contacts is initiated.

It is a further object of the invention to provide such an arrangement wherein the speed of opening of the arcing contacts is independent of the rate at which the main contacts open.

It is an additional object of the invention to provide such a switch contact arrangement wherein the spring for driving the movable arcing contact to its open position is tensioned during the first part of the opening movement of the movable main contact.

It is yet another object of the invention to provide such an arrangement wherein the movable main and arcing contacts move together during their closing movement, the arcing contacts closing before the main contacts close.

It is still a further object of the invention to provide such an arrangement wherein the movable arcing contact is gripped against movement during the tensioning of its opening spring so that the spring is ineffective until opening of the arcing contacts is positively initiated.

BRIEF DESCRIPTION OF THE DRAWINGS

Additional objects and features of the invention will be apparent from the following description in which reference is made to the accompanying drawings.

In the drawings.

Figure 1:
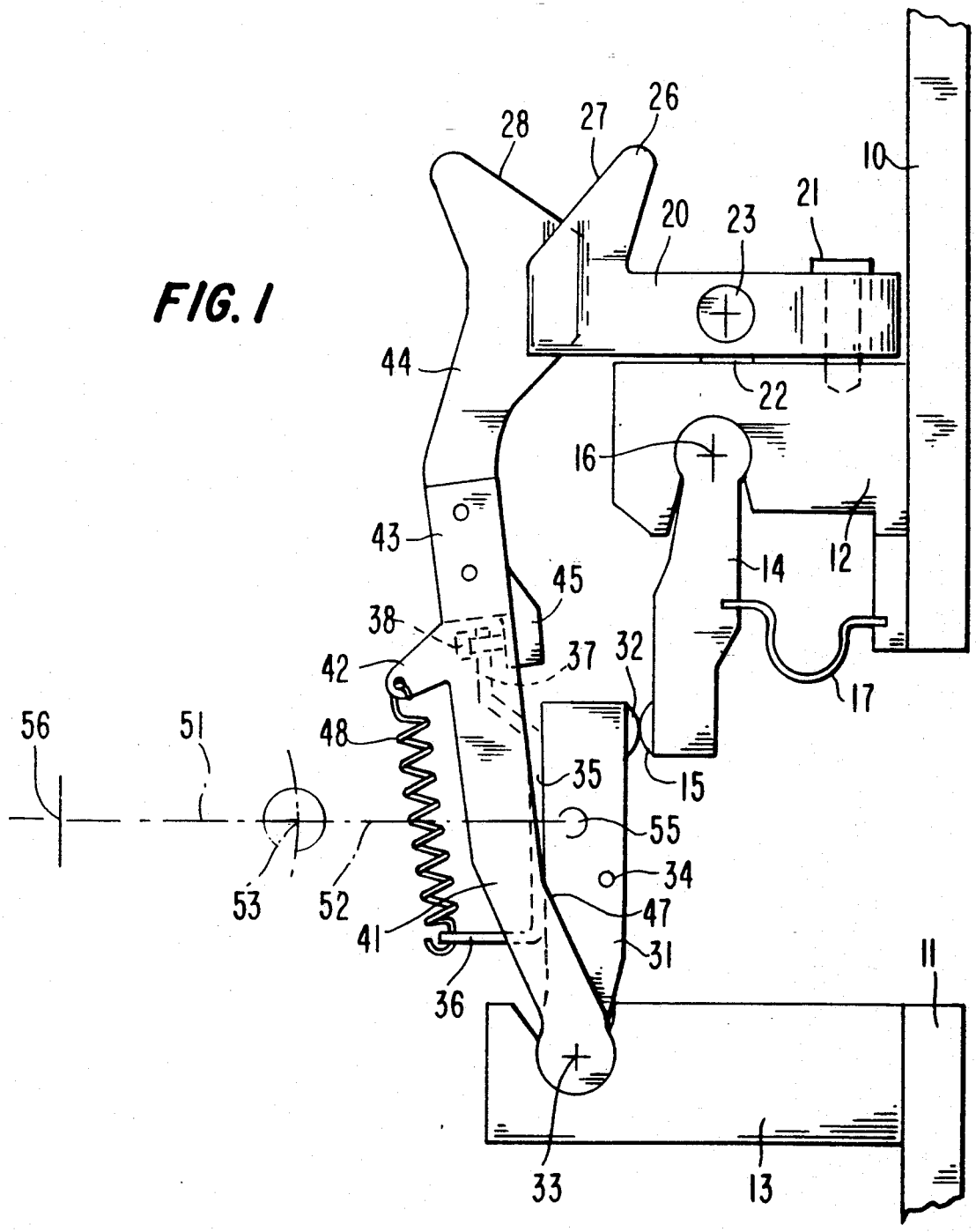
FIG. 1 is a fragmentary side elevational view of an electrical switch contact arrangement, the main and arcing contacts being fully closed.

The switch chosen to illustrate the present invention is used to connect or disconnect a power source bus 10 and a load bus 11 (FIG. 1). A mounting block 12 is fixed to source bus 10, and another mounting block 13 is fixed to load bus 11. Block 12 carries the stationary contacts of the switch, and block 13 carries the movable contacts.

Figure 5:
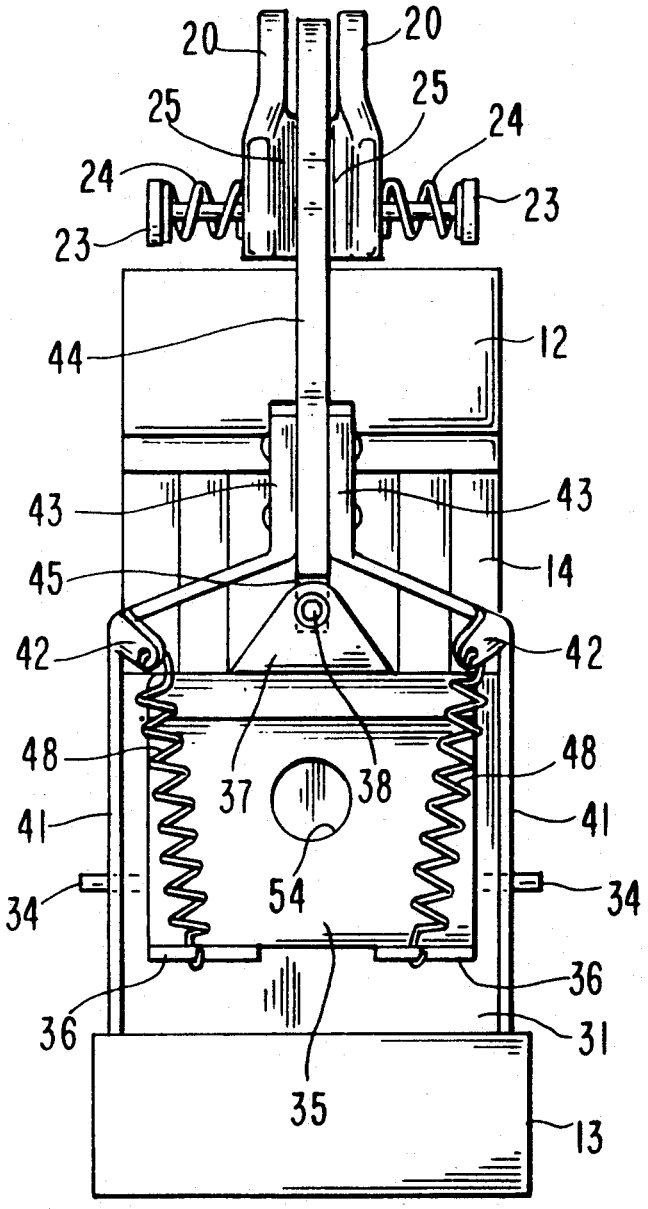
FIG. 5 is a front elevational view of the contact arrangement of FIG. 1.

Mounted within block 12 is a stationary main contact arm 14, (FIGS. 1 and 5) carrying at its lower end stationary main contact 15. Contact arm 14 is actually capable of a small degree of arcuate movement about pivot axis 16, and is constantly urged toward the left, or clockwise, in FIG. 1 by a spring 17. This spring-backed mounting insures good contact between the stationary and movable main contacts.

Secured to the top of block 12 are a pair of parallel plates 20 (FIGS. 1, 5, and 6) constituting the stationary arcing contact. The plates 20 are held by, and swingable about, a bolt 21 threaded into block 12. Block 12 also carries a stationary post 22 from which headed pins 23 project through the holes in plates 20. Compression springs 24 surround pins 23 and seat against the heads of the pins and the plates 20 so as to constantly urge the plates toward each other. At its end opposite bolt 21, each plate is formed with a ridge-like protuberance 25, the two protuberances opposing each other. That end of each plate 20 is also formed with an arc-guiding tail 26 having an angled edge 27 which diverges from an angled edge 28 of the movable arcing contact. As an arc moves upwardly along these diverging edges it is lengthened and hence more easily extinguished.

Mounted within block 13 is a movable main contact arm 31 (FIGS. 1 and 5) carrying at its upper end movable main contact 32. The latter is engageable with contact 15, as shown in FIG. 1, to close the main contacts of the switch. Contact arm 31 is pivotable with respect to block 13 about pivot axis 33 Movable main contact arm 31 carries two lateral projections in the form of pins 34. A bracket 35 is fixed to contact arm 31, the bracket including two fingers 36 at its lower end, bent at right angles to the body of the bracket, and a tongue 37 at its upper end bent out of the plane of the bracket body. Tongue 37 carries a detent in the form of a set screw 38.

A movable arcing contact assembly includes two brackets 41 (FIGS. 1 and 5) pivoted at their lower ends in block 13 about the same axis 33 around which contact arm 31 is pivoted. Around its midpoint, each bracket 41 is bent toward the other, at which point a tab 42 extends from each bracket, and closer to their upper ends the brackets are bent again to define two parallel heads 43. Sandwiched between heads 43 is the lower end of a movable arcing contact 44 having a blade-like configuration. Depending from arcing contact 44 is a stop 45 engageable by detent 38.

Figure 6:
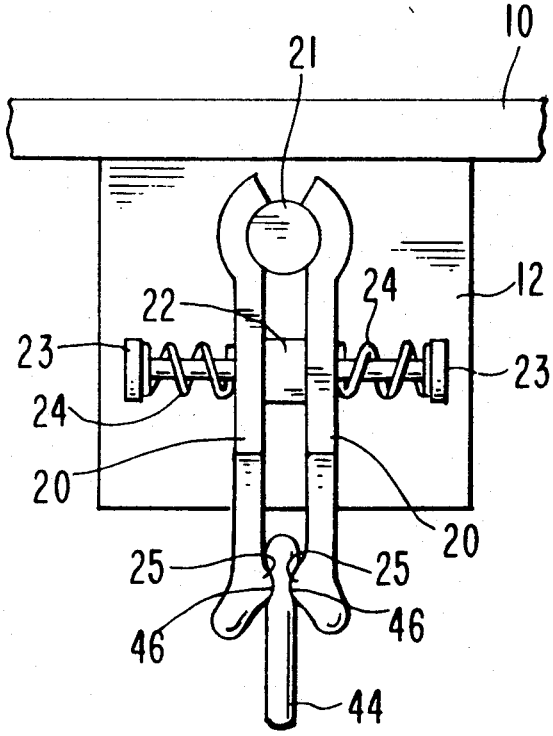
FIG. 6 is a fragmentary top view of the closed arcing contacts.

Near its upper end, the arcing contact blade 44 is formed in its opposite faces with depressions 46 (FIG. 6) which accommodate the protuberances 25 of plates 20. Due to the force exerted by springs 24, protuberances 25 are pressed tightly into depressions 46 so that the stationary arcing contact plates 20 securely grip the movable arcing contact blade 44 when the switch is fully closed (FIGS. 1 and 6).

The edge of each bracket 41, near pivot axis 33, constitutes an abutment 47 located in the path of movement of one of the projections 34 carried by contact arm 31. During opening movement of contact arm 31 away from contact arm 14, projections 34 engage abutments 47 to initiate opening movement of the arcing contacts. A tension spring 48 extends between each finger 36 of bracket 35 and a tab 42 of one of the brackets 41. Springs 48 serve to quickly snap the arcing contacts open after opening is initiated by the cooperative engagement of projections 34 and abutments 47.

A conventional operator means for the switch involves a toggle arrangement including two schematically-indicated links 51 and 52 pivoted together at 53. Link 52 passes through a hole 54 (FIG. 5) in bracket 35 and is pivotally connected at 55 to movable main contact arm 31. When the switch is closed, links 51 and 52 are aligned, as shown in FIG. 1.

When the switch is to be opened, link 51 is rotated about axis 56 in the direction of arrow 57 (FIG. 2), thereby causing movable main contact arm 31 to pivot and separate movable main contact 32 from stationary main contact 15 to open the main contacts, without at first disturbing the fully closed condition of the arcing contacts 20 and 44. Since bracket 35 moves with contact arm 31, but arcing contact assembly 41,44 has not yet moved, springs 48 are tensioned, and detent 38 moves away from stop 45.

Figure 2:
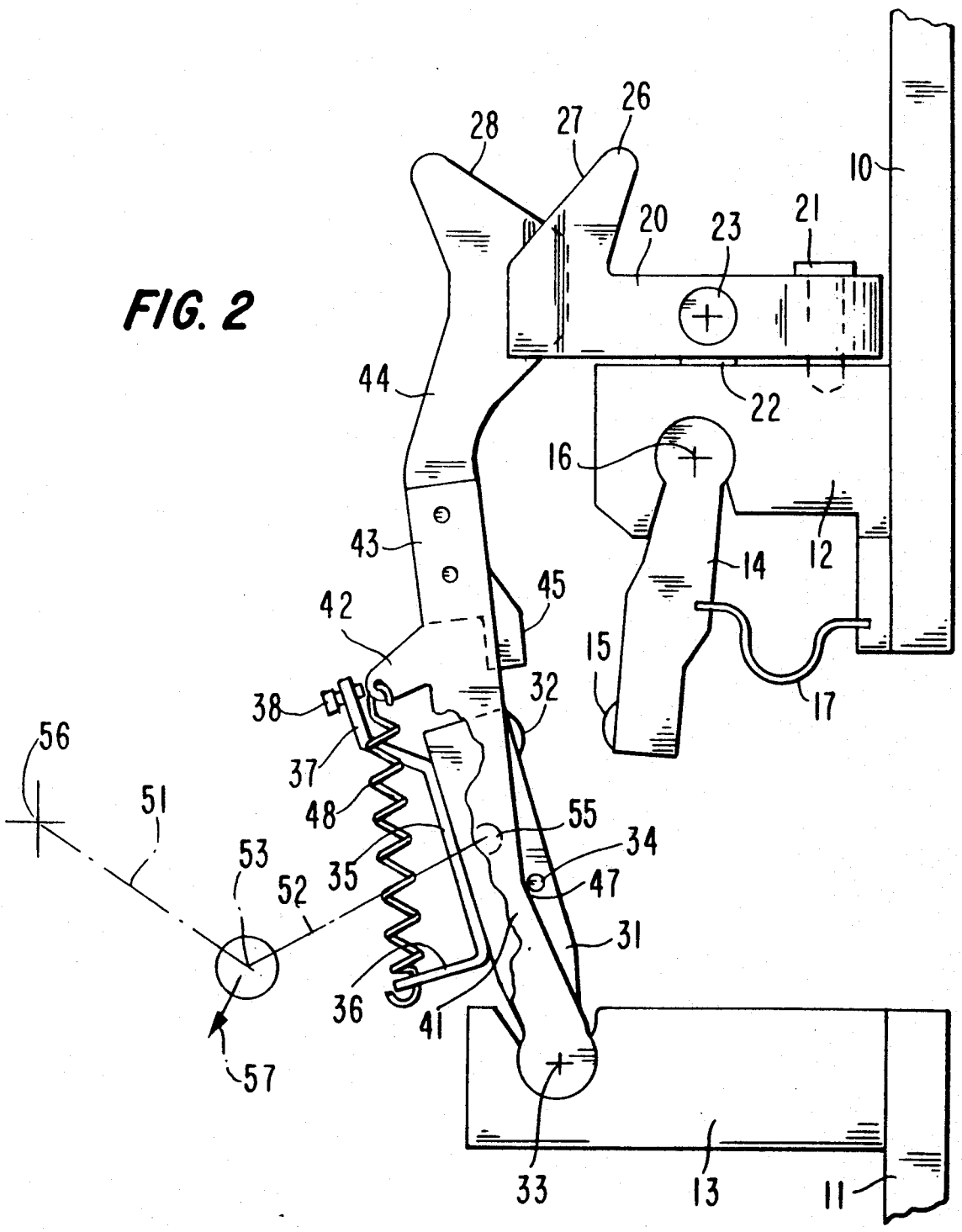
FIG. 2 is a view similar to FIG. 1, the main contacts being about 60% open and the arcing contacts remaining fully closed.
Figure 3:
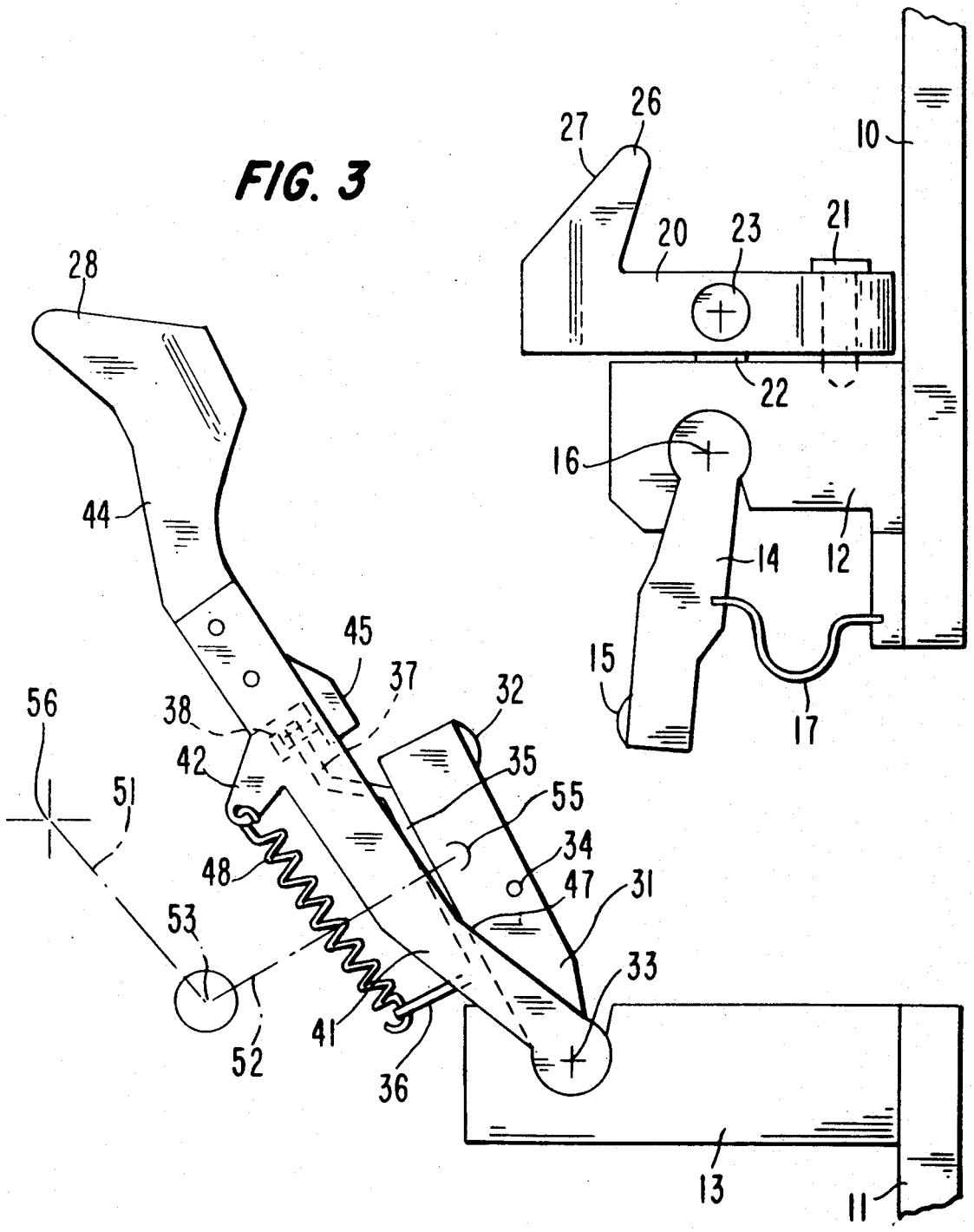
FIG. 3 is a view similar to FIG. 1, the main and arcing contacts being fully open.

When contact arm 31 moves through at least one-half, and preferably 60%, of its total travel away from contact arm 14, projections 34 carried by arm 31 engage abutments 47 of brackets 41, as shown in FIG. 2. Upon such engagement, continued opening movement of contact arm 31, by links 51 and 52, causes contact arm 31 to positively move the movable arcing contact assembly 41,44 in a counterclockwise direction in FIG. 2 resulting in the initiation of the opening movement of the arcing contacts. Specifically, this means that arcing contact blade 44 begins moving out from between stationary arcing contact plates 20, so that protuberances 25 disengage from depression 46, while the blade and plates remain in contact. However, once the grip of plates 20 on blade 44 is relieved in this way, tensioned springs 48 snap movable contact blade 44 away from stationary contact plates at a high rate of speed to very rapidly open the arcing contacts. The fully open switch is shown in FIG. 3, wherein springs 48 have returned to the degree of tension they had when the switch was fully closed, and stop 45 has reengaged detent 38.

Figure 4:
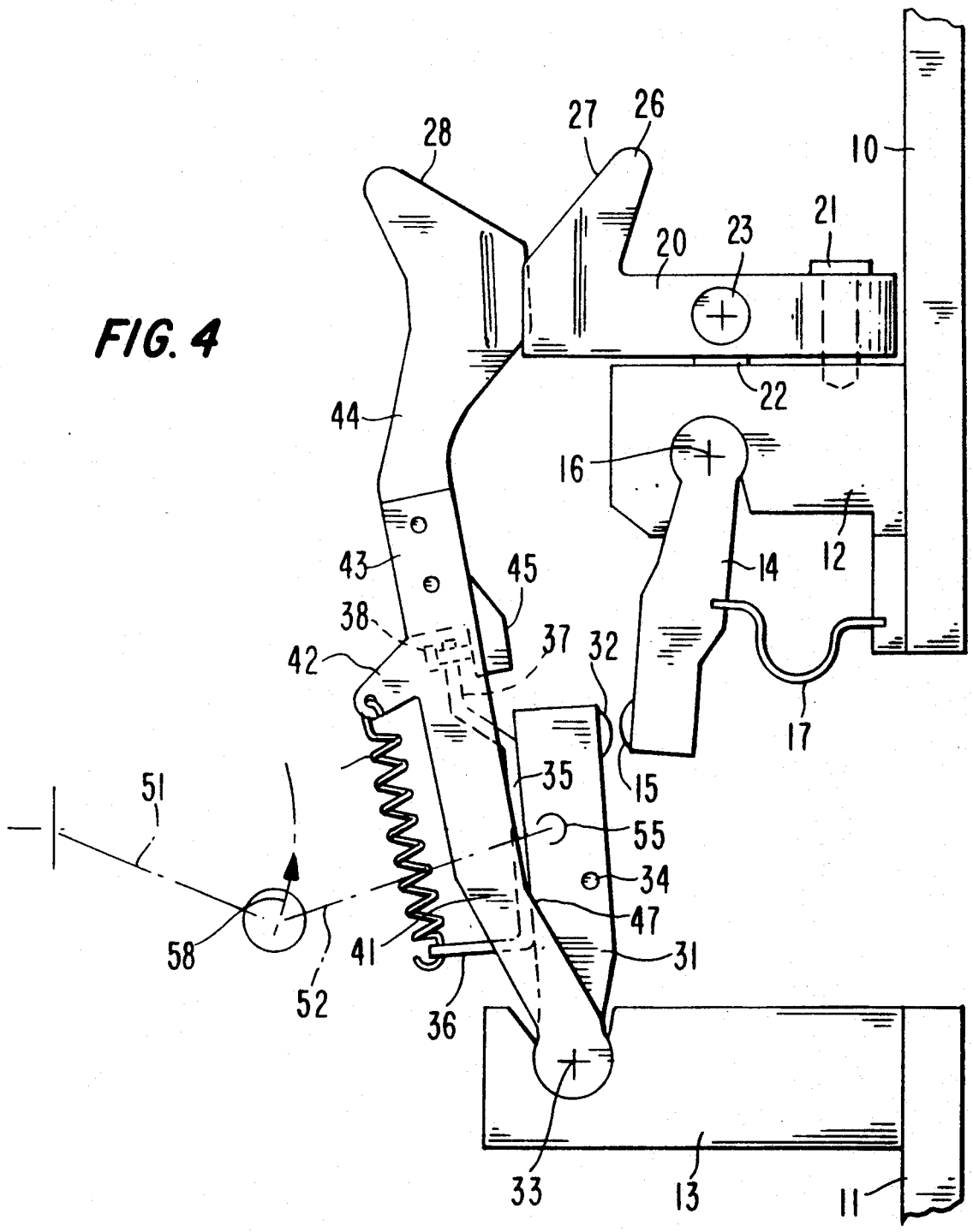
FIG. 4 is a similar view showing the contacts while closing, the arcing contacts having just engaged and the main contacts about to engage.

To close the switch, link 51 is rotated in the direction of arrow 58 in FIG. 4. Links 51 and 52 move contact arm 31 toward contact arm 14, and this movement is transmitted to arcing contact assembly 41,44 through bracket 35, detent 38, and stop 45. In this way, both the movable main and arcing contacts move in unison toward the switch-closed condition. As shown in FIG. 4, movable arcing contact 44 engages stationary arcing contact 20 before movable main contact 32 engages stationary main contact 15, i.e., the arcing contacts close prior to closing of the main contacts. Upon further movement of contact arm 31 from its position in FIG. 4 to the position of FIG. 1, main contacts 32 and 15 engage and contact arm 14 moves slightly against the force of spring 17. At the same time, movable arcing contact blade 44 is positively driven between the stationary arcing contact blades 20 until protuberances 25 snap into depressions 46.

It will be appreciated that the movable arcing contact 44 is positively driven into its closed position, by means of detent 38 and stop 45, and that opening of the arcing contacts is positively initiated, by means of projections 34 and abutments 47, with a lost motion provided between these two drives. The lost motion provided by the spacing between projection 34 and abutments 47, as well as the one-way drive action of detent 38 and stop 45, present the opportunity for springs 48 to rapidly open the arcing contacts independent of the speed of opening of the main contacts.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. An electrical switch contact arrangement comprising:

stationary main and arcing contacts, movable main and arcing contacts cooperable with the stationary main and arcing contacts, respectively, operator means for moving the movable contacts into engagement with the stationary contacts to close the switch and for moving the movable contacts out of engagement with the stationary contacts to open the switch, means responsive to movement of the movable main contact away from the stationary main contact for initiating the opening of the arcing contacts without actually separating the movable and stationary arcing contacts, and resilient means cooperable with the movable arcing contact for the purpose of thereafter snapping the movable arcing contact away from the stationary arcing contact at a high rate of speed to rapidly open the arcing contacts.

2. An electrical switch contact arrangement as defined in claim 1 wherein the movable arcing contact includes a blade, and the stationary arcing contact includes two plates between which the blade is sandwiched when the arcing contacts are closed, and including second resilient means for pressing the plates toward each other to grip the blade between them, the blade moving between the plates in the direction of separation of the arcing contacts to initiate opening of the arcing contacts.

3. An electrical switch contact arrangement as defined in claim 2 including a cooperating depression and protuberance on opposed faces of the blade and at least one of the plates, the protuberance being maintained within the depression, by the second resilient means which press the plates toward each other, when the arcing contacts are fully closed, and the depression and protuberance moving out of engagement upon initiation of the opening of the arcing contacts.

4. An electrical switch contact arrangement as defined in claim 1 wherein the responsive means remains inoperative during at least the first half of the opening movement of the movable main contact away from the stationary main contact, so that the main movable contact moves through at least 50% of its travel away from the main stationary contact before the responsive means initiates the opening movement of the arcing contacts.

5. An electrical switch contact arrangement as defined in claim 4 wherein the responsive means includes a projection fixed with respect to and movable with the movable main contact, an abutment fixed with respect to and movable with the movable arcing contact, the abutment being in the path of movement of the projection and the abutment being spaced from the projection when the main contacts are closed.

6. An electrical switch contact arrangement as defined in claim 4 wherein the operator means is connected to the movable main contact but not to the movable arcing contact.

7. An electrical switch contact arrangement as defined in claim 4 including means for tensioning the resilient means during at least the first half of the opening movement of the movable main contact, the tensioned resilient means snapping the movable arcing contact away from the stationary arcing contact in response to initiation of the opening of the arcing contacts.

8. An electrical switch contact arrangement as defined in claim 7 including a bracket fixed with respect to and movable with the movable main contact, a bracket fixed with respect to and movable with the movable arcing contact, and wherein the resilient means is a spring extending between the two brackets.

9. An electrical switch contact arrangement as defined in claim 1 including cooperable means movable with the moveable main and arcing contacts for, transmitting closing movement of the moveable main contact to the moveable arcing contact, the cooperable means being incapable of transmitting opening movement of the movable main contact to the movable arcing contact.

10. An electrical switch contact arrangement as defined in claim 9 wherein the cooperable means includes a detent fixed with respect to and movable with the movable main contact, and a stop fixed with respect to and movable with the movable arcing contact, the detent and stop being engaged throughout the closing movement of the moveable contacts, and while all the contacts are closed, and the detent and stop separating during the first portion of the opening movement of the movable main contact.

11. An electrical switch contact arrangement as defined in claim 1 wherein the movable main and arcing contacts are mounted for pivotal movement about the same axis, each of the movable main and arcing contacts being pivotable about that axis independently of the other.

12. An electrical switch contact arrangement as defined in claim 1 wherein the responsive means includes a projection fixed with respect to and movable with the movable main contact and an abutment fixed with respect to and movable with the movable arcing contact, the abutment being in the path of movement of the projection, so that opening movement of the movable main contact is transmitted to the movable arcing contact, and means for transmitting closing movement of the movable main contact to the movable arcing contact, the transmitting means including a detent fixed with respect to and movable with the movable main contact and a stop fixed with respect to and movable with the movable arcing contact, the projection being spaced from the abutment when the detent engages the stop, and the detent being spaced from the stop when the projection engages the abutment.

* * * * *